US007140154B2

(12) United States Patent
Governale et al.

(10) Patent No.: US 7,140,154 B2
(45) Date of Patent: Nov. 28, 2006

(54) ASTRAGAL BOOT FOR A DOUBLE DOOR SET

(75) Inventors: Bernard C. Governale, Buford, GA (US); Paul D. Fleming, Glendale, CA (US)

(73) Assignee: W & F Manufacturing, Sun Valley, CA (US)

( * ) Notice: Subject to any disclaimer, the term of this patent is extended or adjusted under 35 U.S.C. 154(b) by 420 days.

(21) Appl. No.: 10/646,998

(22) Filed: Aug. 21, 2003

(65) Prior Publication Data

US 2004/0256858 A1 Dec. 23, 2004

Related U.S. Application Data

(60) Provisional application No. 60/406,568, filed on Aug. 27, 2002.

(51) Int. Cl.
*E06B 7/22* (2006.01)

(52) U.S. Cl. ..... 52/207; 52/211; 52/214; 52/716.2; 49/366; 49/394; 49/395

(58) Field of Classification Search ..... 52/211, 52/204.1, 214, 207, 716.8, 717.01, 718.01, 52/716.2, 292, 293.1, 293.3; 49/366, 394, 49/395; 292/341.14, 341.18, 341.19
See application file for complete search history.

(56) References Cited

U.S. PATENT DOCUMENTS

| | | | | | |
|---|---|---|---|---|---|
| 310,787 | A | | 1/1885 | Buckley | |
| 1,207,600 | A | | 12/1916 | Morgan | |
| 1,510,562 | A | | 10/1924 | Segal | |
| 2,247,556 | A | | 7/1941 | Lazarides | |
| 3,161,925 | A | * | 12/1964 | Bertolini | 49/368 |
| 3,806,175 | A | | 4/1974 | Van Herpen | |
| 4,058,332 | A | | 11/1977 | DiFazio | |
| 4,159,838 | A | | 7/1979 | Wilzig et al. | |
| 4,214,405 | A | * | 7/1980 | Chupik | 49/382 |
| 4,261,189 | A | * | 4/1981 | Brumfield et al. | 70/84 |
| 4,262,450 | A | * | 4/1981 | Anderson | 49/425 |
| 4,315,647 | A | | 2/1982 | Wilzig et al. | |
| D273,090 | S | * | 3/1984 | Imperial | D8/400 |
| 4,625,457 | A | * | 12/1986 | Avery | 49/366 |
| 4,644,696 | A | * | 2/1987 | Bursk | 49/367 |
| 5,071,426 | A | | 12/1991 | Dolgin et al. | |
| 5,290,077 | A | | 3/1994 | Fleming | |
| 5,344,424 | A | | 9/1994 | Roberts et al. | |
| 5,396,735 | A | * | 3/1995 | Dietrich | 49/499.1 |
| 5,403,337 | A | | 4/1995 | Platts | |

(Continued)

FOREIGN PATENT DOCUMENTS

| | | | | |
|---|---|---|---|---|
| DE | 3347321 | * | 7/1985 | 52/211 |

(Continued)

*Primary Examiner*—Phi Dieu Tran A
(74) *Attorney, Agent, or Firm*—Kelly Lowry & Kelley, LLP

(57) ABSTRACT

An astragal boot provides a substantially weatherproof seal at a lower end of a vertically elongated astragal installed on the free side edge or stile of a semi-active door in a double door entry set or the like. The astragal boot includes at least one and preferably multiple compliant fins for engaging an underlying threshold, when the semi-active door is in a closed position, to provide an effective barrier against penetration of wind and water. In the preferred form, the astragal boot further supports and retains adjacent ends of complaint weatherstripping mounted on the astragal and/or the bottom edge of the door. The astragal boot may be provided in a non-handed configuration for reversible mounting on a left-hand or right-hand installed semi-active door.

16 Claims, 10 Drawing Sheets

U.S. PATENT DOCUMENTS

| | | | | |
|---|---|---|---|---|
| 5,481,076 | A * | 1/1996 | Mullet et al. | 200/61.43 |
| 5,611,173 | A * | 3/1997 | Headrick et al. | 49/468 |
| 5,857,291 | A * | 1/1999 | Headrick | 49/368 |
| 6,009,932 | A * | 1/2000 | Smith | 160/371 |
| 6,045,167 | A | 4/2000 | Lauterbach | |
| 6,052,949 | A * | 4/2000 | Procton et al. | 49/506 |
| 6,233,888 | B1 * | 5/2001 | Wu | 52/207 |
| 6,289,635 | B1 * | 9/2001 | Procton et al. | 49/467 |
| 6,301,844 | B1 * | 10/2001 | Richardson | 52/204.591 |
| 6,367,201 | B1 * | 4/2002 | Massey et al. | 49/467 |
| 6,637,158 | B1 * | 10/2003 | Bennett | 49/504 |
| 6,763,639 | B1 * | 7/2004 | Bennett et al. | 52/212 |
| 2003/0052492 | A1 * | 3/2003 | Massey et al. | 292/341.15 |
| 2004/0139667 | A1 * | 7/2004 | Massey et al. | 52/204.1 |
| 2004/0200153 | A1 * | 10/2004 | Khanlarian | 49/468 |

FOREIGN PATENT DOCUMENTS

| | | | | |
|---|---|---|---|---|
| DE | 3546242 | * | 7/1987 | 49/366 |
| JP | 53-136341 | * | 11/1978 | 52/211 |

* cited by examiner

ASTRAGAL BOOT FOR A DOUBLE DOOR SET

The application claims the benefit of U.S. Provisional Application No. 60/406,568, filed Aug. 27, 2002.

BACKGROUND OF THE INVENTION

This invention relates generally to a weatherproofing boot for mounting onto the lower end of a vertically elongated astragal which is installed onto the free side edge of a semi-active door of a double door or panel entry set or the like. The astragal boot provides an effective barrier at the lower end of the astragal for substantially preventing ingress of wind and water when the doors are closed.

A typical double door entry set for a building includes a pair of hinged doors mounted within a stationary door frame for individual swinging movement between open and closed positions. In a typical residential installation, one of the doors comprises a primary or active door intended for routine opening and closing in the course of normal ingress and egress, whereas the other door comprises a secondary or so-called semi-active door which is normally retained in a closed and locked condition. The primary door is equipped with door hardware components including door handles or other suitable actuators for operating retractable door latch and deadbolt devices which commonly engage appropriate keepers mounted on or otherwise formed within a false jamb defined by a vertically elongated astragal mounted on the adjacent free side edge or stile of the semi-active door. In turn, the semi-active door is normally equipped with locking hardware mounted at or near the free side edge thereof, generally proximate the upper and lower ends of the free side edge, such as retractable slide bolts for engaging appropriate keepers mounted respectively on the door header and threshold. These slide bolts are normally advanced to a locked position engaging their respective keepers to retain the semi-active door normally in the closed and locked condition. However, when and if desired, these slide bolts can be retracted for disengagement from their respective keepers to unlock the semi-active door and permit opening thereof. In a common design, actuators for these slide bolts are accessibly exposed at the free side edge of the semi-active door only when the primary door is open. One preferred slide bolt configuration is shown and described in copending U.S. Ser. No. 09/668,530, filed Sep. 21, 2000, which is incorporated by reference herein.

The double door set commonly includes weatherstripping to minimize entry of wind-blown dirt and water past the peripheral edges of the closed doors into the building interior. In a typical configuration, an elongated strip of flexible or compliant weatherproofing material is fastened onto the stationary vertical side jambs and the horizontal header of the door frame for contact by the hinged side and the top edges of the two doors in the closed position. An additional strip of similar weatherproofing material is often fastened onto the astragal for contact by the free side edge of the active door in the closed position. Further strips of flexible or compliant weatherproofing material are normally attached to the bottom edge of each door for engaging the underlying threshold when the doors are closed. These weatherproofing strips are designed to fill any gaps between the peripheral edges of the two doors when closed and the adjoining door frame and threshold, to resist wind and water penetration into the building. However, the weatherproofing strips at the door bottom edges are interrupted or spaced apart by the astragal, when both doors are in the closed position, resulting in an unfilled and open gap at the astragal lower end through which dirt and water can pass into the building. To date, an effective weatherproofing system or weatherstrip mounting arrangement at the astragal lower end has not been provided.

There exists, therefore, a need for further improvements in and to double door or double panel sets of the type having an astragal mounted at the free side edge of a semi-active door or panel, wherein the lower end of the astragal is effectively weatherproofed to close any gap at that location through which wind-blown dirt and water could otherwise enter the building. The present invention fulfills these needs and provides further related advantages.

SUMMARY OF THE INVENTION

In accordance with the invention, an astragal boot is provided for quick and easy mounting onto the lower end of an astragal installed onto the free side edge or stile of a semi-active door in a double door entry set or double panel set or the like, to provide a substantially weatherproof seal at the astragal lower end preventing ingress of wind and water when the doors are closed. The astragal boot includes at least one and preferably multiple flexible or compliant fins for engaging an underlying threshold of the surrounding door frame, to provide an effective barrier against wind and water penetration.

In the preferred form, the astragal boot is constructed from a molded plastic material or the like, having a boot body with size and shape for substantially mated-fit mounting onto the astragal lower end as by means of one or more screws or the like. The plastic boot body may be structurally reinforced by a metal plate attached thereto or co-molded therewith. The astragal boot body further includes at least one bolt port for slide-through passage of a retractable lock bolt engageable with a threshold-mounted keeper for releasibly locking the semi-active door in the closed position. The at least one and preferably multiple fins depend from the boot body with distal end tips having sufficiently flexibility or compliance for smooth and effective sealing engagement with the underlying threshold when the semi-active door is in the closed position. In a preferred geometry, multiple fins are provided and arranged for supporting and retaining adjacent ends of weatherstripping mounted on the bottom edge of the semi-active door. An additional upstanding support pin may also be provided for supporting and retaining the adjacent lower end of vertically extending weatherstripping mounted onto the astragal.

The astragal boot may be provided in a non-handed configuration for reversible mounting on a left-hand or right-hand installed semi-active door. In such non-handed configuration, a pair of bolt ports are formed in the astragal body for sliding passage of the retractable threshold lock bolt through one of said lock ports in accordance with the left- or right-hand mounting orientation. In addition, a pair of upstanding support pins may be provided on the boot body, with one of said support pins supporting and retaining the adjacent lower end of vertically extending weatherstripping mounted onto the astragal in accordance with the left- or right-hand mounting orientation. The second or unused support pin is adapted for cut-off or break-off removal from the astragal boot.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
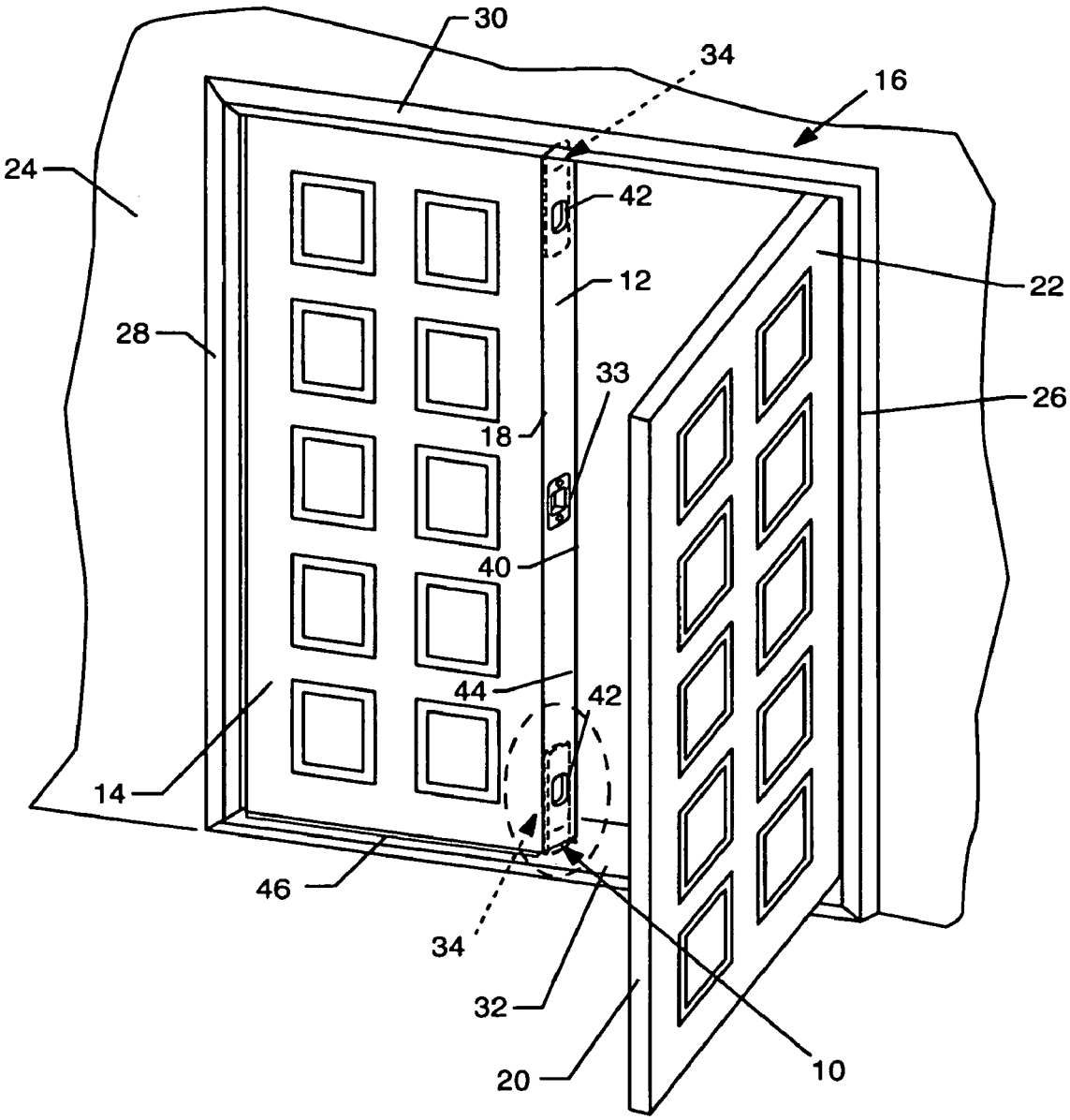
FIG. 1 is a fragmented perspective view illustrating a double door entry set including a primary door shown in an open position and a semi-active door shown in a closed and locked position, wherein the semi-active door includes an astragal with an astragal boot mounted thereon in accordance with the present invention.
Figure 2:
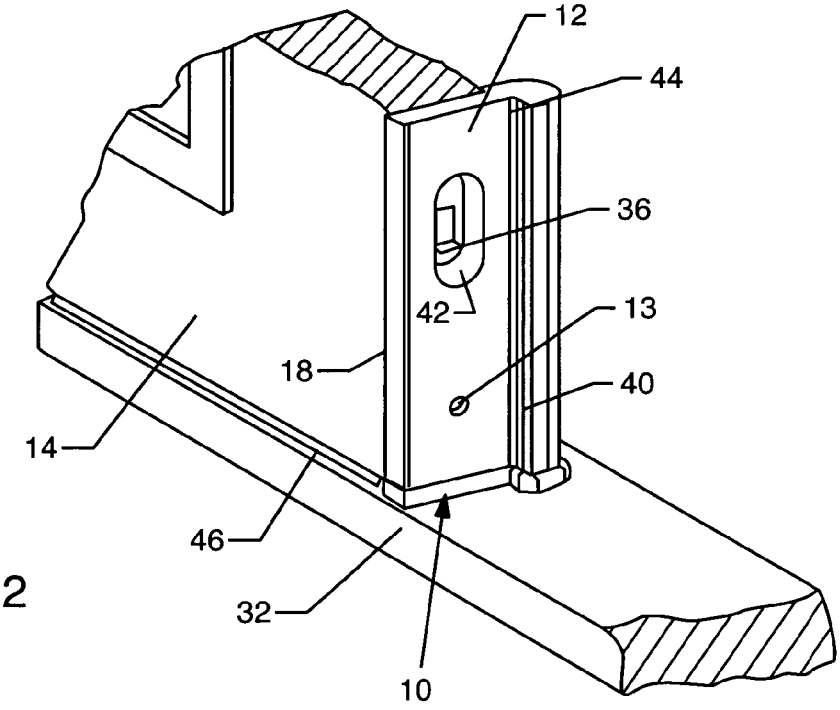
FIG. 2 is an enlarged fragmented perspective view corresponding with the encircled region 2 of FIG. 1.
Figure 3:
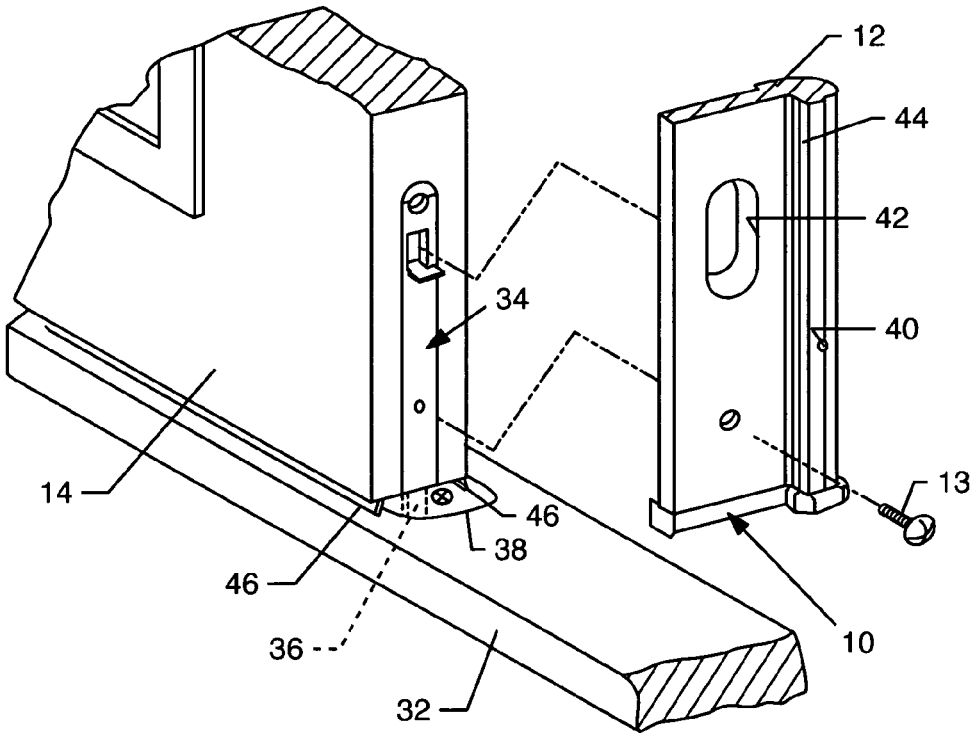
FIG. 3 is an enlarged fragmented perspective view similar to FIG. 2, showing a lower portion of the astragal with astragal boot mounted thereon in exploded relation to the semi-active door.
Figure 4:
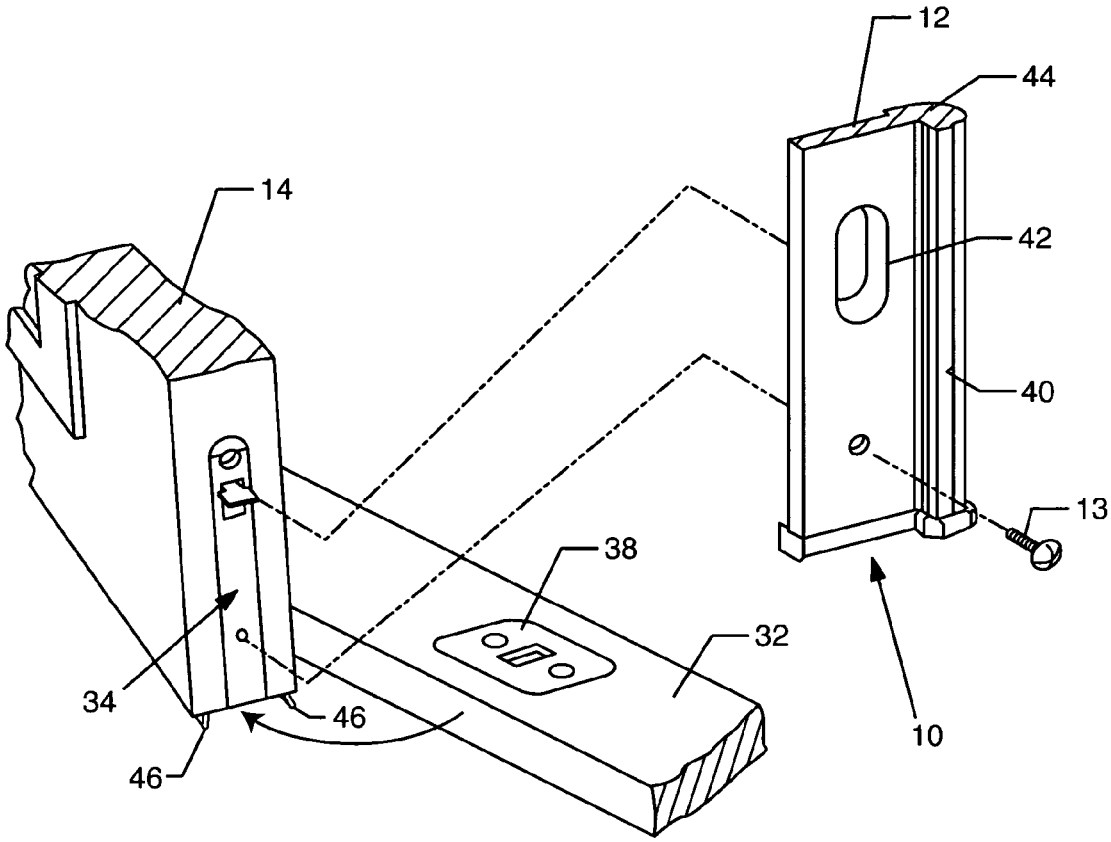
FIG. 4 is an enlarged fragmented perspective view similar to FIG. 3, showing a lock bolt in a retracted position to permit opening of the semi-active door, with a lower portion of the astragal with boot mounted thereon shown in exploded relation thereto.

As shown in the exemplary drawings, an astragal boot referred to generally by the reference numeral 10 in FIGS. 1–9 is provided for mounting onto and substantially weatherproofing the lower end of an astragal 12 installed onto a semi-active door 14 of a double door entry set 16. As shown in FIG. 1, the astragal 12 is installed along a free side edge 18 of the semi-active door 16 to provide a false jamb for engagement by a free side edge 20 of a primary or active door 22 of the double door entry set 16. When both doors 22 and 14 are closed, the astragal boot 10 effectively closes any gap at the lower end of the astragal 12, to correspondingly provide a barrier to ingress of wind-blown dirt and water past the astragal lower end into the interior of the building.

As shown in FIG. 1, the double door entry set 16 generally comprises a door casing or frame mounted within a suitable opening in a building wall 24 to define an opposed pair of stationary door jambs 26 and 28 extending vertically between a stationary upper header 30 and a lower stationary sill or threshold 32. The primary or active door 22 is hingedly supported at one side edge by the door jamb 26 and includes appropriate door latch and/or deadbolt hardware (not shown) at its opposite or free side edge 20 for engaging one or more strike sets or keepers 33 shown mounted centrally along the free side edge 18 of the associated semi-active door 14. In turn, the semi-active door 14 is hingedly supported from the opposite door jamb 28. Upper and lower slide bolt units 34 are mounted on the free side edge 18 of the semi-active door 14, generally at the upper and lower ends thereof, and include slidably movable retractable lock bolts 36 (FIGS. 3 and 6) for respectively engaging matingly positioned keepers 38 (FIGS. 3 and 4) on the header 30 and threshold 32 for releasibly retaining the semi-active door 14 in a closed and locked condition. The astragal 12 comprises a trim strip mounted as by screws 13 or the like onto the free side edge 18 of the semi-active door 14, opposite the hinged side thereof, and provides a convenient laterally projecting door stop or jamb surface 40 for engagement by the active door 22 in the closed position. Suitable apertures 42 (FIGS. 1–3) may be formed in the astragal 12 to accommodate manual fingertip access to the lock bolts 36, the upper ends of which are shown recessed within said apertures 42. In this regard, while the specific geometry of the slide bolt units 34 may vary, one preferred configuration is shown and described in copending U.S. Ser. No. 09/668,530, filed Sep. 21, 2000, which is incorporated by reference herein.

The illustrative double door entry set 16 incorporates conventional weatherstripping for minimizing or eliminating penetration of wind-blown dirt and water from the exterior side past the closed doors 22 and 14 into the interior of the building. In this regard, although not shown in the accompanying drawings, an elongated weatherproofing strip formed from a suitable resilient or compliant material is commonly attached to the upstanding stationary door jambs 26, 28 and to the horizontally extending header 30, generally in an inverted U-shaped configuration, for compression engagement by the hinged side edges and the top edges of the two doors 22, 14 in the closed position. In addition, a strip 44 (FIGS. 1–4 and 6–9) of similar weatherproofing material is commonly attached to an inboard surface of the astragal stop or jamb 40 for compression engagement by the free side edge 20 of the active door 22, when both doors are closed. Finally, in accordance with conventional weatherproofing techniques, at least one and preferably multiple strips 46 of similar weatherproofing material are attached to the bottom edge 48 of each door 22, 14 (shown in FIG. 6 with respect to the semi-active door 14) for resiliently engaging the threshold 32 when the doors are closed. Each of these weatherproofing strips is intended to close any gap between the associated door in the closed position and the surrounding structure to minimize or prevent entry of dirt and water past the closed doors into the building interior.

The astragal boot 10 of the present invention is specifically designed for mounting onto the lower end of the astragal 12, for the purpose of closing any residual gap between the astragal lower end and the threshold 30 when the semi-active door 14 is closed. In this regard, in the past, the bottom edge weatherstripping 46 on the two doors 22, 14 has not effectively closed this gap at the lower end of the astragal 12, but instead has left a residual gap at the astragal lower end.

Figure 5:
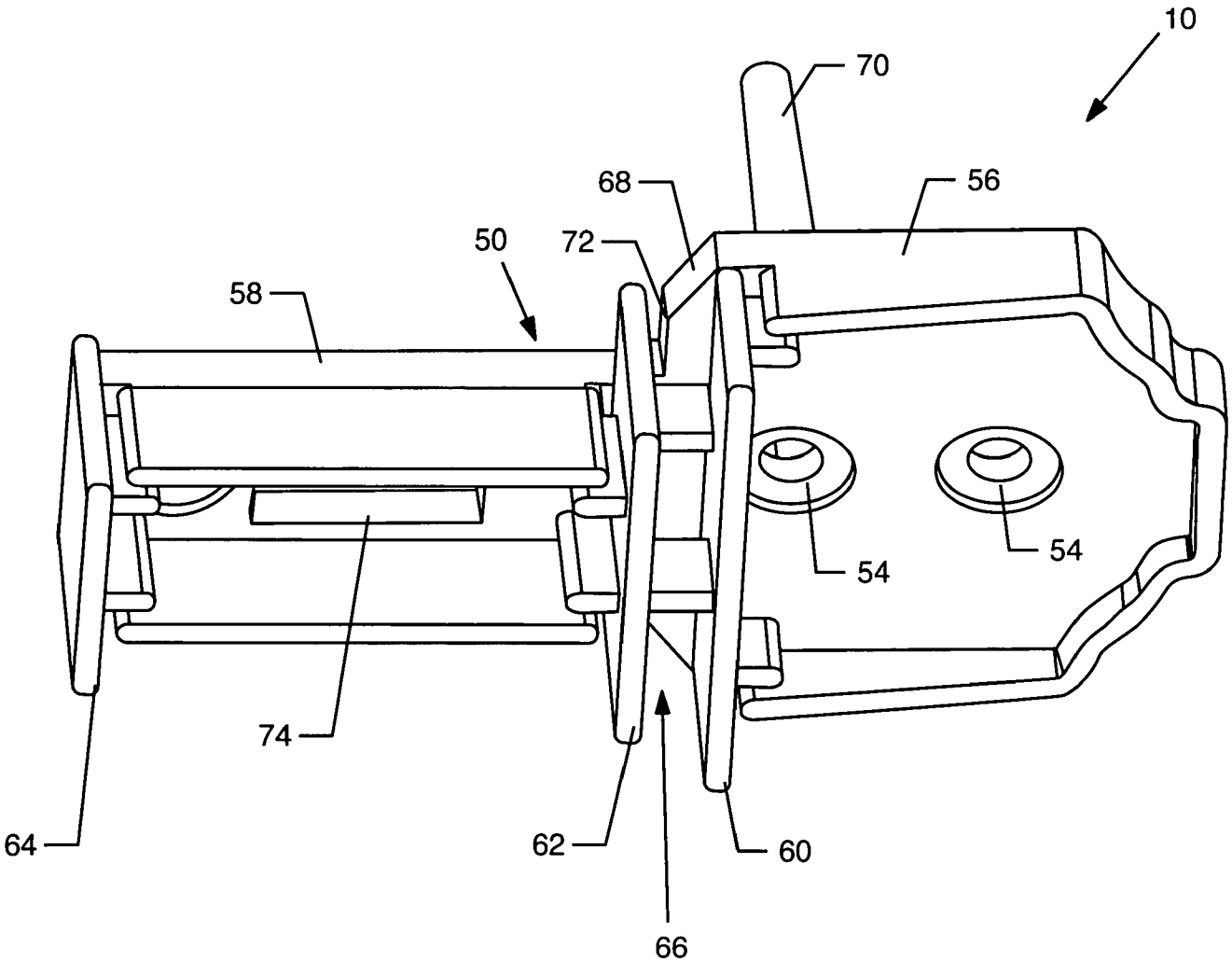
FIG. 5 is an enlarged bottom perspective view showing the astragal boot in one preferred form.
Figure 6:
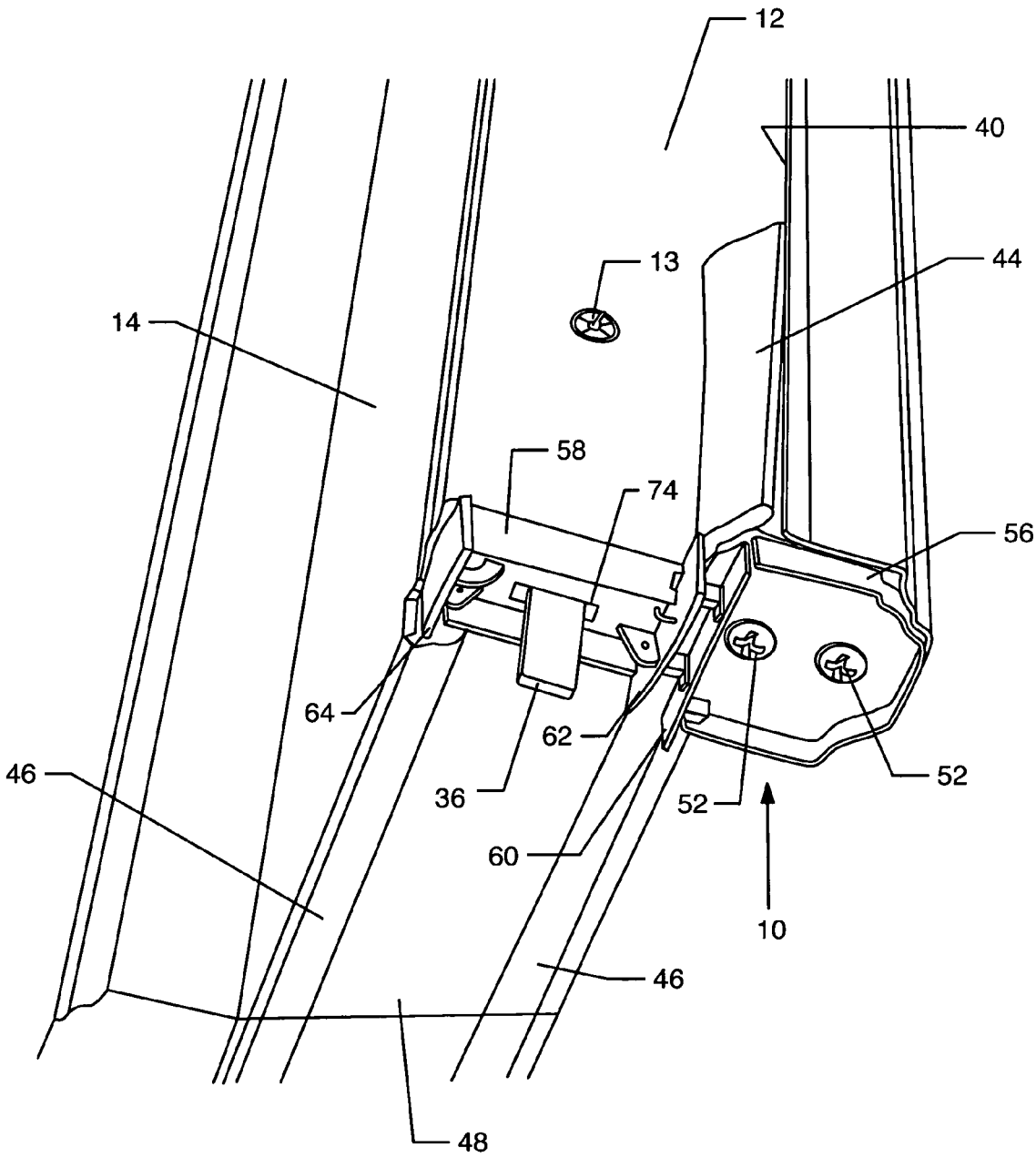
FIG. 6 is a fragmented bottom perspective view illustrating the astragal boot mounted onto a lower end of the astragal, which is mounted in turn onto a free side edge or stile of the semi-active door.
Figure 7:
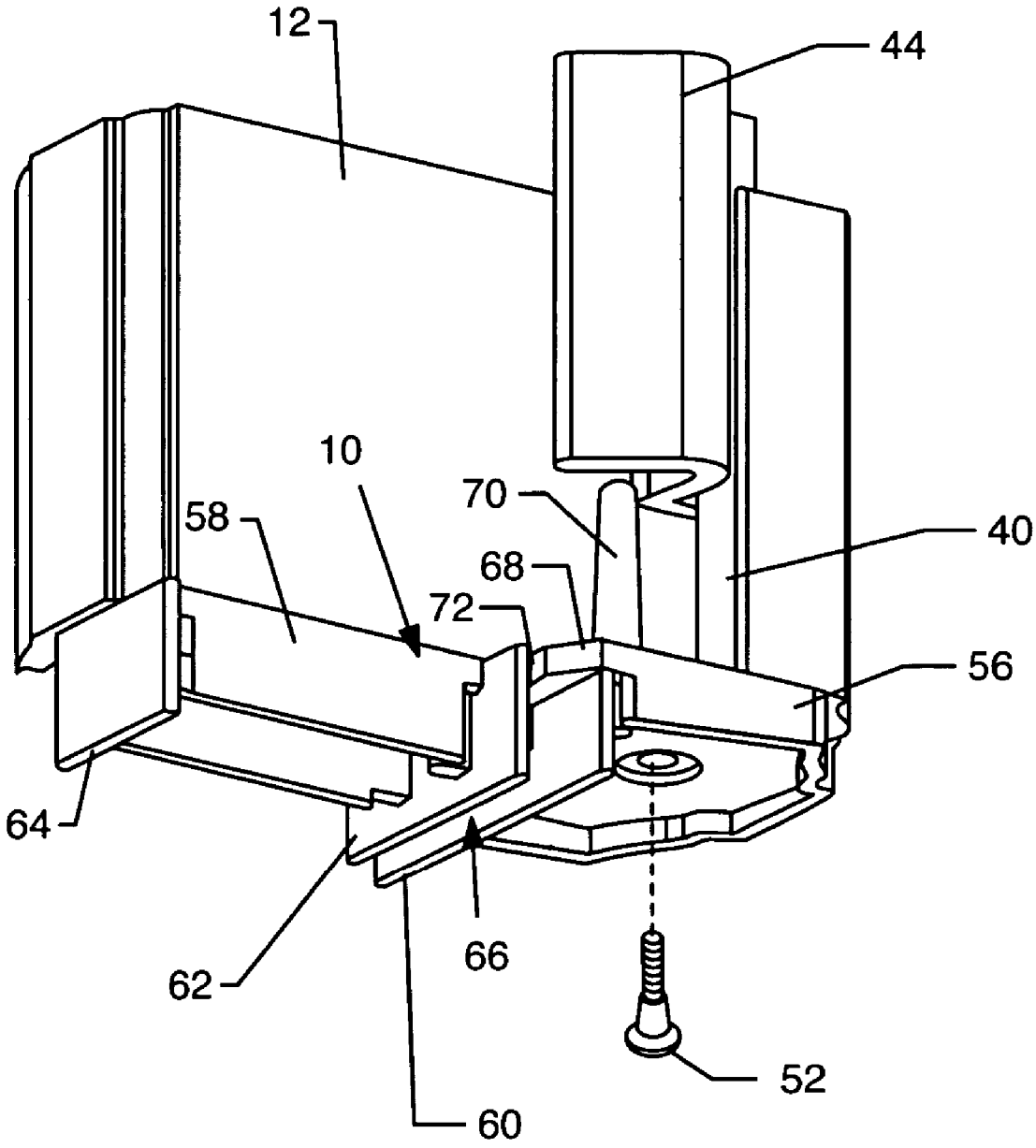
FIG. 7 is a fragmented perspective view showing mounting of the astragal boot onto the lower end of the astragal.

As shown best in FIGS. 5–9, the astragal boot 10 of the present invention has a size and shape generally conforming and matingly adapting to the contoured cross sectional profile of the astragal 12. In a preferred form, the astragal boot 10 may be constructed from a suitable molded plastic or the like to include a boot body 50 sized and shaped for mating mount onto the astragal lower end by means of a pair of screws 52 (FIG. 6) or the like passed through screw ports 54 (FIGS. 5 and 7). An outboard or leading end portion 56 of the astragal body 50 is relatively widened for matingly underlying the widened outboard end of the astragal 12, particularly the portion thereof defining the stop or jamb 40 to be engaged by the free side edge 20 of the active door 22 in the closed position. From this widened outboard or leading end 56, the astragal boot 10 protrudes rearwardly to define an inboard or trailing end portion 58 underlying the typically narrower, inboard portion of the astragal 12.

At least one and preferably a plurality of compliant fins project downwardly from the astragal boot 10, for sealing engaging the underlying threshold 32 when the semi-active door 14 is closed. FIGS. 5–9 show a pair of spaced-apart, generally parallel fins 60 and 62 formed generally at a juncture of the wider leading end portion 56 and the narrower trailing end portion 58 of the boot body 50. An additional fin 64 projects downwardly from the inboard or trailing end of the boot body narrower portion 58. Each of these fins 60, 62 and 64 is sufficiently resilient or compliant for engaging the underlying threshold 32 when the door 14 is closed, in a substantially sealed manner to block or close any gap that would otherwise be present at the lower end of the astragal 12. Accordingly, these fins provide an effective barrier to dirt and water penetration at this point in the overall door assembly. In a preferred form, the fins 60, 62 and 64 are each relatively stiff adjacent the boot body 50 but increase in flexibility toward the lower or distal ends thereof.

In accordance with one feature of the invention, the forward spaced-apart pair of the fins 60, 62 are configured to define a laterally open recess 66 therebetween for receiving and retaining the adjacent end of one of the weatherstrips 46 mounted on the bottom edge 48 of the semi-active door (as viewed best in FIG. 6). In this regard, an upper margin of this strip-receiving recess 66 may incorporate a cut-out or break-off wall segment 68 (FIG. 5) that can be removed for improved seating of the end of the weatherstrip 46 therein.

Figure 8:
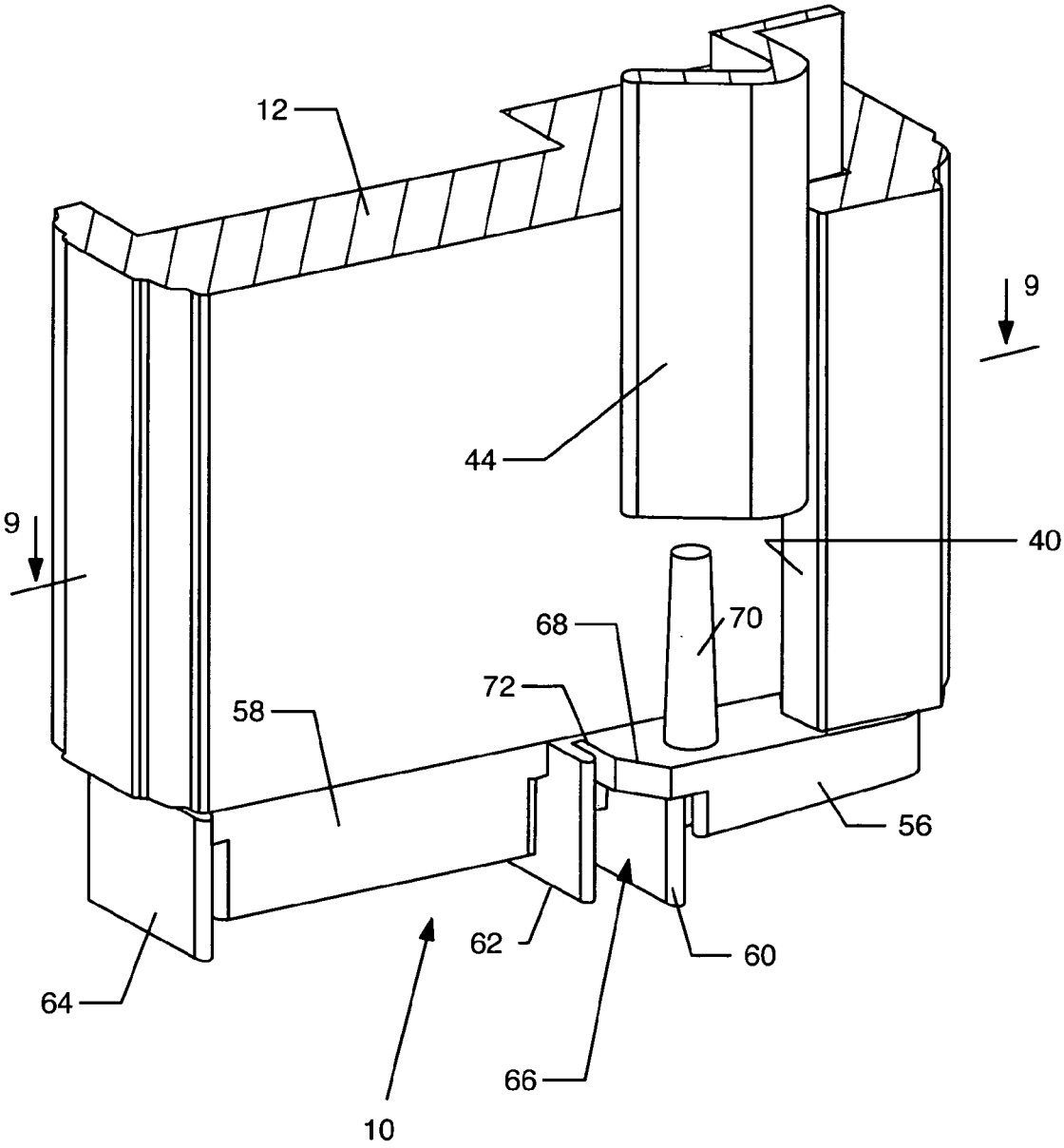
FIG. 8 is a further enlarged fragmented perspective view similar to FIG. 7.
Figure 9:
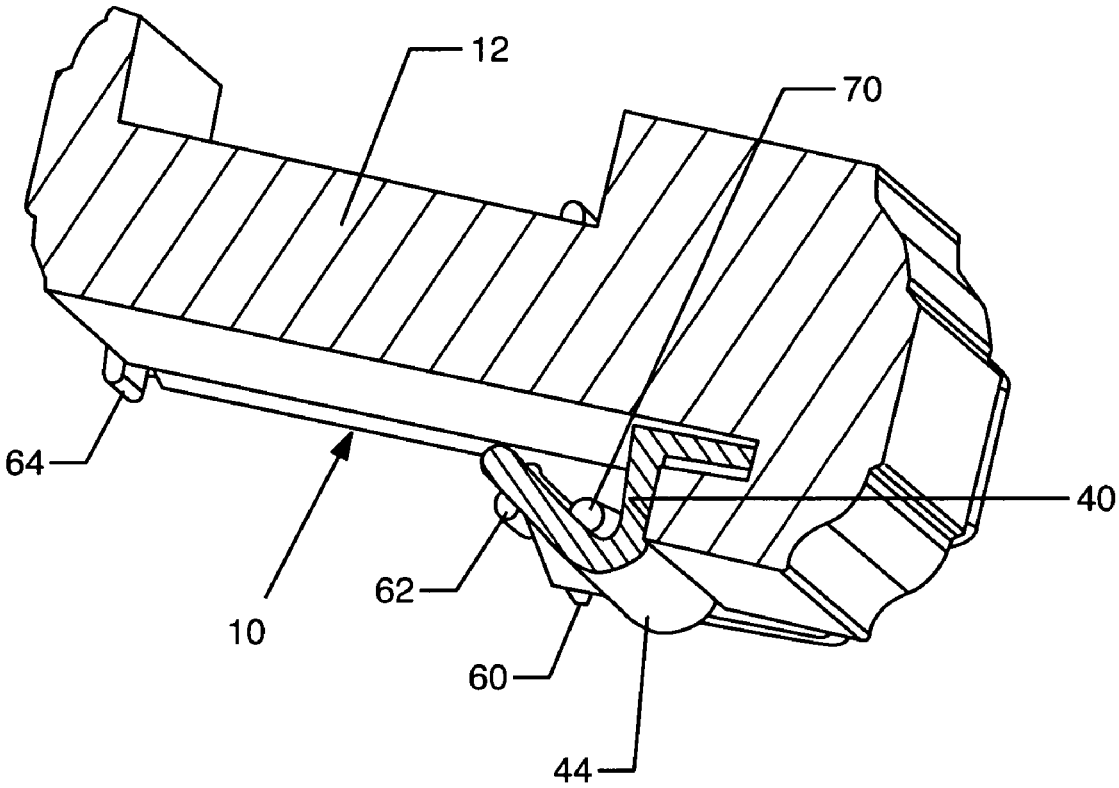
FIG. 9 is a fragmented sectional view taken generally on the line 9—9 of FIG. 8.

A support pin 70 may also be provided to upstand from boot body 50 to support and retain a lower end of the vertically extending weatherstrip 44 mounted on the astragal stop or jamb 40. FIGS. 6–9 illustrate the support pin 70 upstanding a short distance from an upper side of the boot body 50, at a location generally nested in the corner defined by the astragal stop or jamb 40. A lower end of the associated weatherstrip 44 can be received and seated over this support pin 70 for securely locking the weatherstrip 44 in place (FIGS. 7–9). In this regard, a lower edge of the weatherstrip 44 can beneficially be received into a slot 72 formed in the side of the boot body.

The narrower trailing end portion 58 of the boot body 50 further includes a bolt port 74 for slide-through reception of the retractable lock bolt 36 used for normally retaining the semi-active door 14 in the closed and locked position. FIGS. 5–6 show this bolt port 74 in the form of an elongated slot for sliding passage of the blade-shaped lock bolt 36 shown in the illustrative drawings.

In use, the astragal boot 10 of the present invention is quickly and easily installed onto the lower end of the astragal 12, preferably in meshed or interlocking assembly with the weatherstrip 44 on the astragal and one of the weatherstrips 46 on the door bottom edge 48. When the two doors 22, 14 are in the closed position, the resilient fins 60, 62 and 64 on the underside of the boot 10 engage and substantially seal with the underlying threshold 32. Importantly, these fins effectively span the gap or space between the weatherstrips 46 on the bottom edges of the two doors. The bolt port 74 in the boot 10 accommodates appropriate sliding displacement of the lock bolt 36 for locking and unlocking the semi-active door 14 in a normal manner.

Figure 10:
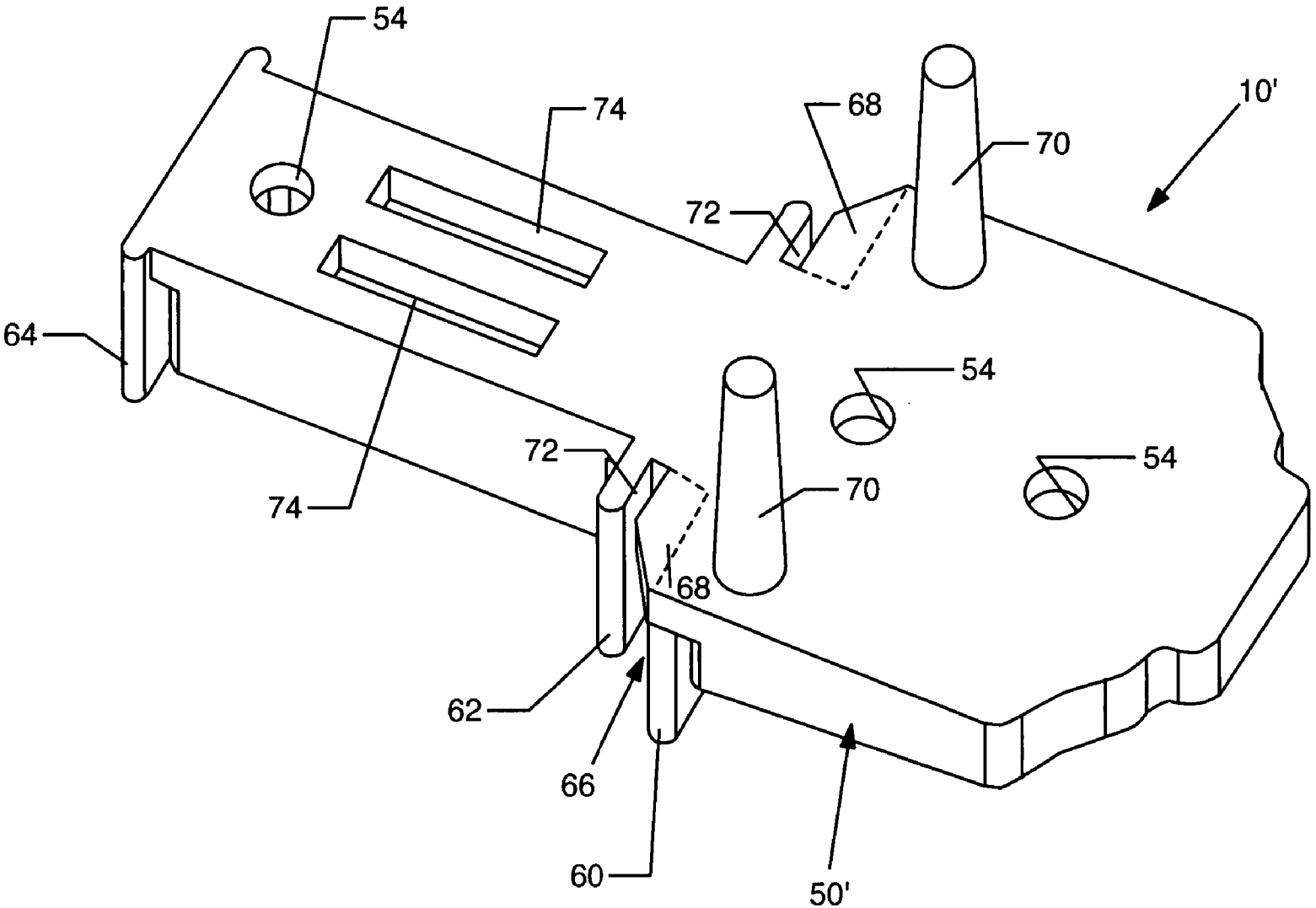
FIG. 10 is an enlarged top perspective view showing the astragal boot in one alternative preferred form.

FIG. 10 illustrates one alternative preferred form of the astragal boot, identified by reference numeral 10', wherein the astragal boot is designed for reversible or non-handed mounted onto the lower end of an astragal 12 in a left- or right-hand door installation. More particularly, as shown, the modified astragal 10' includes a boot body 50' shaped for mounting onto the astragal lower end, and further including the downwardly projecting fins 60, 62 and 64 for sealingly engaging an underlying threshold 32 when the door is closed. The modified boot body 50' includes a pair of laterally open recesses 66, each of which is closed at the upper end thereof by a cut-out or break-off wall segments 68 having the weatherstrip slot 72 formed therein. The modified boot body 50' also includes a pair of laterally spaced-apart support pins 70 projecting upwardly therefrom.

On installation, the modified astragal boot 10' is fastened onto the lower end of a left- or right-hand mounted astragal 12 at the free side edge of a left- or right-hand mounted semi-active door 14. Prior to such installation of the astragal boot 10', the support pin 70 at the side facing the free side edge 18 of the door 14 is removed by cutting or breaking away. In addition, the breakaway wall segment 68 at the same side of the boot body 50' may be severed and removed, if desired for improved reception of the adjacent end of the bottom weatherstrip 46. Importantly, the modified boot body 50' includes a pair of spaced-apart bolt ports 74 for sliding passage of the lock bolt 36 through one of the ports 74, according to the left- or right-hand directional mounting.

Figure 11:
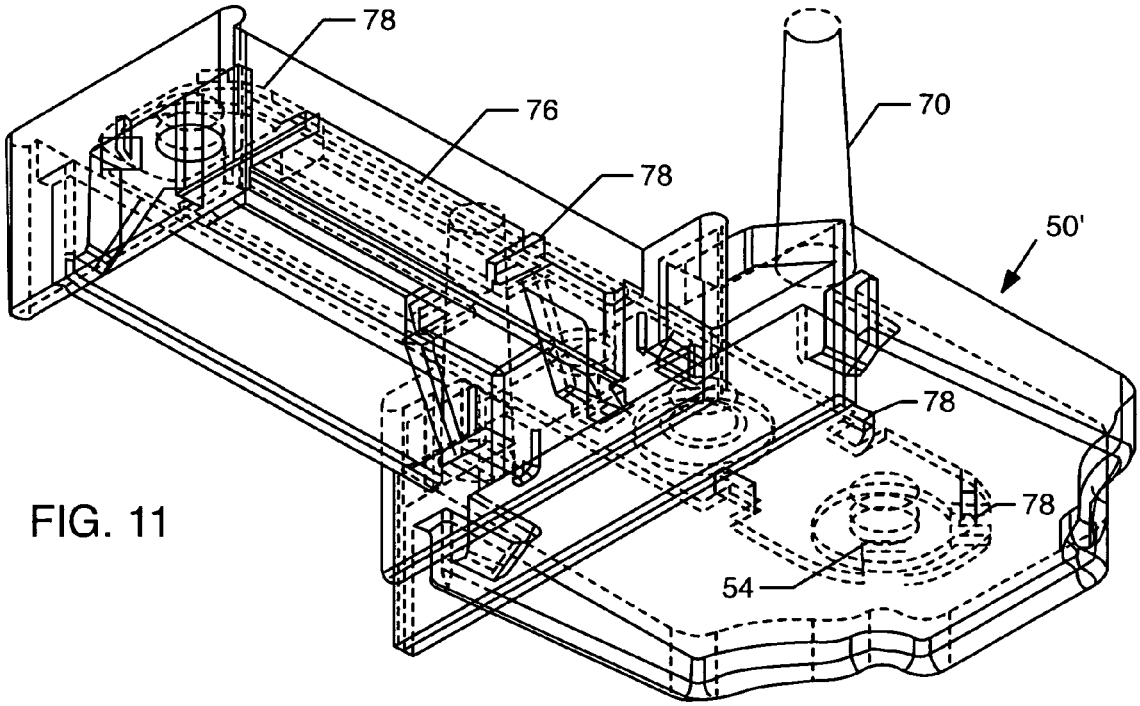
FIG. 11 is an enlarged top perspective view showing the astragal boot in accordance with a further alternative preferred form of the invention.
Figure 12:
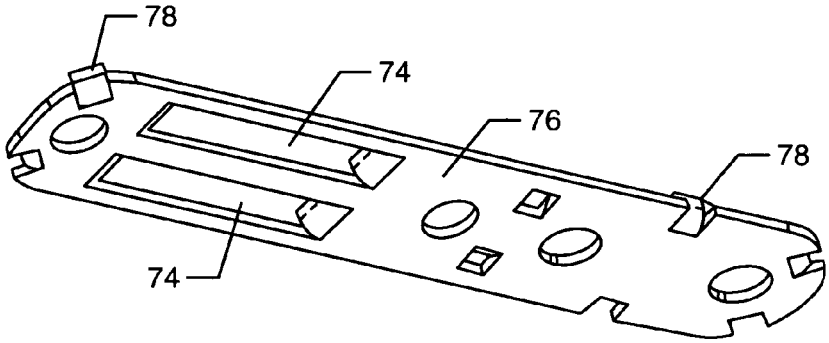
FIG. 12 is a perspective view of a reinforcing plate for use in the modified astragal boot of FIG. 11.

FIGS. 11–12 show a further alternative preferred form of the invention, wherein the boot body 50' is structurally reinforced by a rigid plate 76 which can be formed from metal or the like. This reinforcing plate 76 can be assembled with the boot body as by snap-fit mounting in a predetermined location defined by an array of vertically projecting snap tabs 78 adapted for snap-fit reception into matingly shaped aligned slots formed in the boot body 50'. Alternatively, persons skilled in the art will recognize that the reinforcing plate 76 may be comolded directly as a portion of the boot body. While this reinforcing plate 76 is shown by way of addition to the modified body 50', it will be appreciated and understood that the reinforcing plate may be used with the boot body 50 shown in FIGS. 1–10. FIG. 12 shows the reinforcing plate 76 with a pair of bolt ports 74 for alternative left- or right-hand directional mounting on a door.

A variety of further modifications and improvements in and to the astragal boot 10 of the present invention will be apparent to those persons skilled in the art. For example, while the invention is shown and described for specific use with a double door set, it will be recognized and appreciated that the astragal boot can be used with any double panel set to closed and seal the lower end of an astragal-type structure at the juncture between the two hinged panels. In addition, it will be understood that the astragal boot 10 may be integrated with the lower slide bolt unit 34 wherein these combined elements may be adapted for concurrent mounting as a single assembly onto the lower free side edge of the semi-active door 14. Accordingly, no limitation on the invention is intended by way of the foregoing description and accompanying drawings, except as set forth in the appended claims.

What is claimed is:

1. In combination with a double panel set including a frame defining an opposed pair of jambs extending between an upper header and a lower threshold, primary and semi-active panels hingedly supported respectively by said pair of said jambs, an astragal disposed at a free side edge of said semi-active panel and defining a stop surface for engagement by a free side edge of said primary panel when said primary and semi-active panels are in a closed position, and weatherstripping carried at the bottom edges of said primary and semi-active panels for engaging said threshold when each of said panels is in the closed position, an astragal boot comprising:

a boot body at a lower end of said astragal, said boot body carrying at least one fin projecting downwardly therefrom for engaging said threshold when the semi-active panel is in a closed position for substantially closing a gap between adjacent ends of said weatherstripping carried at the bottom edges of said panels when said panels are in the closed position;

said at least one fin comprising a pair of fins carried by said boot body in generally spaced-apart, substantially parallel relation to define a recess therebetween for receiving and supporting an adjacent end of the weatherstripping carried at said bottom edge of said semi-active panel.

2. The combination of claim 1 wherein said boot body is formed from a molded plastic material having a size and shape for substantially mated-fit mounting onto the lower end of said astragal.

3. The combination of claim 2 wherein said boot body further includes a substantially rigid reinforcing plate.

4. The combination of claim 1 further including at least one bolt port formed in said boot body for slide-through passage of a lock bolt carried by said semi-active panel and engageable with a keeper on said threshold.

5. The combination of claim 1 further including a support pin upstanding from said boot body, said support pin being engageable with and supporting a lower end of a weatherstrip carried by said astragal.

6. The combination of claim 1 further including a slot formed in said boot body for receiving and supporting a lower end of a weatherstrip carried by said astragal.

7. The combination of claim 1 wherein said boot body is reversibly mountable onto the lower end of said astragal carried by said semi-active panel in respective right- and left-hand orientations.

8. The combination of claim 1 wherein said semi-active panel comprises a semi-active door, and wherein said primary panel comprises a primary door.

9. In combination with a double panel set including a frame defining an opposed pair of jambs extending between an upper header and a lower threshold, primary and semi-active panels hingedly supported respectively by said pair of said jambs, an astragal disposed at a free side edge of said semi-active panel and defining a stop surface for engagement by a free side edge of said primary panel when said primary and semi-active panels are in a closed position, and weatherstripping carried at the bottom edges of said primary and semi-active panels for engaging said threshold when each of said panels is in the closed position, an astragal boot comprising:

a boot body at a lower end of said astragal, said boot body carrying at least one fin projecting downwardly therefrom for engaging said threshold when the semi-active panel is in a closed position for substantially closing a gap between adjacent ends of said weatherstripping carried at the bottom edges of said panels when said panels are in the closed position; and further including a slot formed in said boot body for receiving and supporting a lower end of a weatherstrip carried by said astragal.

10. The combination of claim 9 wherein said boot body is formed from a molded plastic material having a size and shape for substantially mated-fit mounting onto the lower end of said astragal.

11. The combination of claim 10 wherein said boot body further includes a substantially rigid reinforcing plate.

12. The combination of claim 9 further including at least one bolt port formed in said boot body for slide-through passage of a lock bolt carried by said semi-active panel and engageable with a keeper on said threshold.

13. The combination of claim 9 wherein said at least one fin comprising a pair of fins carried by said boot body in generally spaced-apart, substantially parallel relation to define a recess therebetween for receiving and supporting an adjacent end of the weatherstripping carried at said bottom edge of said semi-active panel.

14. The combination of claim 9 further including a support pin upstanding from said boot body, said support pin being engageable with and supporting a lower end of a weatherstrip carried by said astragal.

15. The combination of claim 9 wherein said boot body is reversibly mountable onto the lower end of said astragal carried by said semi-active panel in respective right- and left-hand orientations.

16. The combination of claim 9 wherein said semi-active panel comprises a semi-active door, and wherein said primary panel comprises a primary door.

* * * * *